US011028537B2

(12) United States Patent
Vogel et al.

(10) Patent No.: US 11,028,537 B2
(45) Date of Patent: Jun. 8, 2021

(54) DISPERSIBLE WET WIPES CONSTRUCTED WITH PATTERNED BINDER

(71) Applicant: Kimberly-Clark Worldwide, Inc., Neenah, WI (US)

(72) Inventors: Nathan John Vogel, Neenah, WI (US); Amanda Ann Gantz, Greenville, WI (US); Nicholas Scott Walker, Greenville, WI (US); David James Sealy Powling, Combined Locks, WI (US); Carly Elizabeth Herr, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 26 days.

(21) Appl. No.: 16/333,716

(22) PCT Filed: Dec. 30, 2016

(86) PCT No.: PCT/US2016/069364
§ 371 (c)(1),
(2) Date: Mar. 15, 2019

(87) PCT Pub. No.: WO2018/125177
PCT Pub. Date: Jul. 5, 2018

(65) Prior Publication Data

US 2019/0226149 A1 Jul. 25, 2019

(51) Int. Cl.
*D21H 19/66* (2006.01)
*D04H 1/66* (2012.01)
(Continued)

(52) U.S. Cl.
CPC ..... *D21H 19/66* (2013.01); *A47K 10/16* (2013.01); *D04H 1/425* (2013.01); *D04H 1/66* (2013.01);
(Continued)

(58) Field of Classification Search
CPC ... Y10T 442/50; Y10T 442/51; Y10T 442/54; Y10T 442/56; Y10T 442/59;
(Continued)

(56) References Cited

U.S. PATENT DOCUMENTS 2,705,498 A 4/1955 Johnson
2,705,687 A 4/1955 Petterson De Witt et al.
(Continued)

FOREIGN PATENT DOCUMENTS

CN 1440473 A 9/2003
CN 101331222 A 12/2008
(Continued)

OTHER PUBLICATIONS

Co-pending U.S. Appl. No. 16/333,767, filed Mar. 15, 2019, by Vogel et al. for "Method of Making Dispersible Wet Wipes Via Patterned Binder Application."

*Primary Examiner* — Maria V Ewald
*Assistant Examiner* — Ethan A. Utt
(74) *Attorney, Agent, or Firm* — Kimberly-Clark Worldwide, Inc.

(57) ABSTRACT

A dispersible wet wipe includes a layer of cellulosic fibers. In one embodiment, a first binder is applied in a coating comprising randomly distributed deposits of the binder. A second binder is applied in an intermittent pattern on the surface to define first regions on the surface that include first binder but no second binder and to define second regions on the surface that include both first binder and second binder. The first and second binders can have the same chemical composition. In a second embodiment, a first binder is applied to a web surface in a first pattern, and, after applying the first binder, a second binder is applied to the web surface in a second pattern that is different than the first pattern. In a third embodiment, a binder is applied to a web surface in
(Continued)

a pattern, the pattern having first regions and second regions, wherein the add-on level of the binder in the first regions is lower than the add-on level of the binder in the second regions.

20 Claims, 4 Drawing Sheets

(51) Int. Cl.

| | |
|---|---|
| ***D06B 11/00*** | (2006.01) |
| ***D04H 1/425*** | (2012.01) |
| ***D04H 1/732*** | (2012.01) |
| ***A47K 10/16*** | (2006.01) |
| ***D21H 19/82*** | (2006.01) |
| ***D06B 1/02*** | (2006.01) |
| ***D06B 1/14*** | (2006.01) |
| ***D06B 19/00*** | (2006.01) |
| ***D21H 21/18*** | (2006.01) |
| ***D21H 23/22*** | (2006.01) |
| ***D21H 23/50*** | (2006.01) |

(52) U.S. Cl.
CPC ..... *D04H 1/732* (2013.01); *D06B 1/02* (2013.01); *D06B 1/14* (2013.01); *D06B 11/0056* (2013.01); *D06B 19/0005* (2013.01); *D21H 19/82* (2013.01); *D21H 21/18* (2013.01); *D21H 23/22* (2013.01); *D21H 23/50* (2013.01)

(58) Field of Classification Search
CPC ..... Y10T 442/60; Y10T 442/659; Y10T 442/664; Y10T 442/668; Y10T 442/671; Y10T 442/693; Y10T 442/20; Y10T 442/2041; Y10T 442/2049; Y10T 442/2057; Y10T 442/2066; Y10T 442/2074; Y10T 442/2082; Y10T 442/209; Y10T 442/2098; Y10T 442/2107; Y10T 442/2115; Y10T 442/2123; Y10T 442/2131; Y10T 442/2762; Y10T 442/277; Y10T 442/2779; Y10T 442/2787; Y10T 442/2795; Y10T 442/2803; Y10T 442/2811; Y10T 442/282; Y10T 442/2828; Y10T 442/2836; Y10T 442/2844; Y10T 442/2852; Y10T 442/2861; Y10T 442/2869; Y10T 428/24355; Y10T 428/24372; Y10T 428/2438; Y10T 428/24397; Y10T 428/24405; Y10T 428/24446; Y10T 428/24455; Y10T 428/24463; Y10T 428/24802; Y10T 428/24893; Y10T 428/24901; Y10T 428/24909; Y10T 428/24934; Y10T 428/31971; Y10T 428/31975; Y10T 428/31978; Y10T 428/31982; Y10T 428/31986; Y10T 428/31993; D21H 1/00; D21H 1/02; D21H 1/04; D21H 3/00; D21H 3/82; D21H 3/825; D21H 5/00; D21H 5/0005; D21H 5/0047; D21H 5/12; D21H 5/14; D21H 5/141; D21H 5/143; D21H 5/145; D21H 5/146; D21H 5/148; D21H 5/26; D21H 5/265; D21H 5/2657; D21H 5/2664; D21H 5/2678; D21H 5/2685; D21H 5/2692; D21H 11/00; D21H 11/02; D21H 11/04; D21H 11/06; D21H 11/08; D21H 11/10; D21H 11/12; D21H 11/16; D21H 11/20; D21H 11/22; D21H 13/00; D21H 13/02; D21H 13/04; D21H 13/06; D21H 13/08; D21H 19/00; D21H 19/10; D21H 19/12; D21H 19/14; D21H 19/16; D21H 19/18; D21H 19/20; D21H 19/22; D21H 19/24; D21H 19/26; D21H 19/28; D21H 19/30; D21H 19/32; D21H 19/34; D21H 19/36; D21H 19/38; D21H 19/385; D21H 19/40; D21H 19/42; D21H 19/44; D21H 19/46; D21H 19/48; D21H 19/50; D21H 19/52; D21H 19/54; D21H 19/56; D21H 19/58; D21H 19/60; D21H 19/62; D21H 19/66; D21H 19/68; D21H 19/72; D21H 19/74; D21H 19/76; D21H 19/78; D21H 19/80; D21H 19/82; D21H 19/822; D21H 19/824; D21H 19/826; D21H 19/828; D21H 19/84; D21H 27/00; D21H 27/30; D21H 27/32; D21H 27/38; D21H 27/40; D21H 27/42; D21H 21/00; D21H 21/14; D21H 21/18; D21H 21/20; D21H 23/00; D21H 23/02; D21H 23/22; D21H 23/24; D21H 23/26; D21H 23/28; D21H 23/30; D21H 23/50; D21H 23/52; D21H 23/56; D21H 23/58; D21H 23/60; D21H 23/62; D04H 1/00; D04H 1/40; D04H 1/42; D04H 1/425; D04H 1/58; D04H 1/587; D04H 1/593; D04H 1/60; D04H 1/62; D04H 1/64; D04H 1/641; D04H 1/642; D04H 1/643; D04H 1/655; D04H 1/66; D04H 1/70; D04H 1/72; D04H 1/732; D04H 13/00; D04H 13/001; D04H 13/002; D04H 13/006; A47K 10/00; A47K 10/16; D06B 11/00; D06B 11/056; D06B 11/059; D06B 11/0073; D06B 11/0093; B32B 3/00; B32B 3/02; B32B 3/10; B32B 3/14; B32B 3/16; B32B 3/26; B32B 5/00; B32B 5/02; B32B 5/022; B32B 5/22; B32B 5/24; B32B 5/26; B32B 29/00; B32B 29/002; B32B 29/005; B32B 29/02; B32B 29/06; B32B 33/00; B32B 2250/20; B32B 2255/00; B32B 2255/02; B32B 2255/12; B32B 2255/26; B32B 2255/28; B32B 2262/04; B32B 2307/70; B32B 2307/716; B32B 2307/7163; B32B 2307/7166; B32B 2432/00; B32B 2555/00; B32B 2555/02; B05D 2203/00; B05D 2203/22; B05D 1/00; B05D 1/02; B05D 1/26; B05D 1/28; B05D 1/32; B05D 1/34; B05D 1/36
USPC ..... 162/100, 103, 104, 123, 132, 133, 162/135–137, 157.1, 157.6, 157.7, 231; 442/320, 321, 323, 324, 326, 327, 381, 442/385, 389, 392, 412, 59, 64–75, 442/152–165; 428/141, 143, 144, 146, 428/147, 152–154, 195.1, 206–208, 428/211.1, 532–536, 537.5; 427/256, 427/258, 261, 263, 265, 267, 268, 427/280–282, 286, 288
See application file for complete search history.

(56) References Cited

U.S. PATENT DOCUMENTS

| | | | |
|---|---|---|---|
| 3,093,502 | A | 6/1963 | Drelich |
| 3,554,788 | A | 1/1971 | Fechillas |

(56) References Cited

U.S. PATENT DOCUMENTS

| | | | |
|---|---|---|---|
| 3,563,241 | A | 2/1971 | Evans et al. |
| 3,616,797 | A | 11/1971 | Champaigne, Jr. et al. |
| 3,727,615 | A | 4/1973 | Duchane |
| 3,753,826 | A | 8/1973 | Plummer |
| 3,798,120 | A | 3/1974 | Enloe |
| 5,143,776 | A | 9/1992 | Givens |
| 5,405,501 | A | 4/1995 | Phan et al. |
| 5,500,068 | A | 3/1996 | Srinivasan et al. |
| 5,935,880 | A | 8/1999 | Wang et al. |
| 6,149,768 | A | 11/2000 | Hepford |
| 6,670,521 | B2 | 12/2003 | Noda et al. |
| 6,683,041 | B1 | 1/2004 | Nissing et al. |
| 6,994,865 | B2 | 2/2006 | Branham et al. |
| 7,297,231 | B2 | 11/2007 | Goulet et al. |
| 7,419,570 | B2 | 9/2008 | Chen et al. |
| 7,585,797 | B2 | 9/2009 | Vogel et al. |
| 7,767,059 | B2 | 8/2010 | Ryan et al. |
| 7,789,994 | B2 | 9/2010 | Hupp et al. |
| 9,121,137 | B2 | 9/2015 | Viazmensky et al. |
| 9,399,841 | B2 | 7/2016 | Yamada |
| 2003/0032352 | A1 | 2/2003 | Chang et al. |
| 2003/0077970 | A1 | 4/2003 | DeLucia et al. |
| 2004/0099389 | A1* | 5/2004 | Chen ..... D21F 9/00 162/134 |
| 2008/0268205 | A1 | 10/2008 | Vogel et al. |
| 2011/0290437 | A1 | 12/2011 | Vogel et al. |
| 2012/0258640 | A1 | 10/2012 | Rice |
| 2013/0198984 | A1 | 8/2013 | Strandqvist et al. |
| 2014/0173841 | A1* | 6/2014 | Hurley ..... D04H 1/587 15/104.93 |
| 2015/0330029 | A1 | 11/2015 | Ramaratnam et al. |
| 2016/0159007 | A1 | 6/2016 | Miller, IV et al. |
| 2017/0247825 | A1 | 8/2017 | Hall |

FOREIGN PATENT DOCUMENTS

| | | | |
|---|---|---|---|
| CN | 105307549 | A | 2/2016 |
| CN | 105579630 | A | 5/2016 |
| GB | 1441690 | A | 7/1976 |
| GB | 1452325 | A | 10/1976 |
| WO | 9640497 | A1 | 12/1996 |
| WO | 9844181 | A1 | 10/1998 |
| WO | 9923290 | A1 | 5/1999 |

* cited by examiner

DISPERSIBLE WET WIPES CONSTRUCTED WITH PATTERNED BINDER

BACKGROUND OF THE DISCLOSURE

Pre-moistened wipes are popular in the marketplace, including, for example, baby wipes, toddler wipes, surface cleaning wipes, feminine wipes, hemorrhoid wipes, make-up removal wipes, and child and adult toileting wipes. Consumers flush many of these wipes down the toilet. Some of the wipes are designed to be flushed, and labeled as such. It is important that wipes that are intended to be flushed are compatible with sewer and septic systems, but also important that such wipes do not fall apart when used for their intended purpose. Specifically, when a flushable disposable product is flushed down a toilet into sewer or septic systems, the product, or designated portions of the product, should degrade or lose strength as it moves through various steps of wastewater processing.

One common approach to making a flushable wet wipe is using "hydroentangling" technology, in which fibers, primarily or exclusively cellulosic fibers, are "entangled" together using very small high-pressure water jets. However, some wipes made with this technology require a substantial amount of agitation to break apart after flushing, and some wipes, if made to have a very high initial strength, may not lose significant strength in relatively static environments.

Another conventional approach to making a wet wipe that exhibits satisfactory in-use strength, but that adequately breaks down in sewer or septic systems, is via the use of a binder on a substrate comprising cellulose fibers. The binder attaches to cellulose fibers, and bonds those fibers together in a network to deliver in-use strength. The binder is stable and delivers this strength when soaking in a stabilizing solution, but swells and weakens in the tap water of the toilet and sewer system, thus allowing the fiber network to break apart. The strength of the wipe can be manipulated by varying the amount of binder used and the process conditions by which the binder is applied, such as how and when it is applied to the wipe substrate, and by varying the time and temperature at which the binder is dried/cured.

One variant of such a binder/stabilizing solution is a salt-sensitive triggerable binder, such as that disclosed in U.S. Pat. No. 6,994,865. The binder holds the fibers of the wet wipe together when soaked in a salt solution, which stabilizes the binder. When the salt solution is washed away, the binder swells and fails, and the wipes lose strength. However, such binders can be relatively expensive, and it can be challenging to achieve the right balance of in-use strength and post-flush degradation when using such binders. For example, the binder add-on level can be reduced to improve dispersibility and reduce cost, but in-use strength (during toileting) can suffer. Conversely, the binder add-on can be increased to improve in-use performance (during toileting), but dispersibility can suffer, and cost increases.

What is needed is a cellulose-based wipe that combines sufficient in-use strength, adequate strength loss after flushing even in relatively non-turbulent water, and that is cost-effective.

SUMMARY OF THE INVENTION

In a first embodiment, the invention provides a dispersible wet wipe that includes a layer of cellulosic fibers, the layer having a first surface and a second surface. A first binder is applied in a coating on the first surface, wherein the coating comprises randomly distributed deposits of the first binder.

A second binder is applied in an intermittent pattern on the first surface to define first regions on the first surface that include first binder but no second binder and to define second regions on the first surface that include both first binder and second binder.

In a second embodiment, the invention provides the wet wipe of the first embodiment wherein the layer of cellulosic fibers comprises a first sub-layer of wetlaid tissue and a second sub-layer of airlaid tissue.

In a third embodiment, the invention provides the wet wipe of either the first or second embodiment wherein the coating is a spray coating.

In a fourth embodiment, the invention provides the wet wipe of any of the first through third embodiments wherein the intermittent pattern is a roll-printed pattern.

In a fifth embodiment, the invention provides the wet wipe of any of the first through fourth embodiments wherein the intermittent pattern is a lattice pattern.

In a sixth embodiment, the invention provides the wet wipe of any of the first through fifth embodiments wherein the intermittent pattern comprises continuous lines of second binder that extend in a primarily cross-machine direction, and wherein the intermittent pattern does not comprise continuous lines of second binder that extend in a primarily machine direction.

In a seventh embodiment, the invention provides the wet wipe of the sixth embodiment wherein the continuous lines of second binder are on average spaced apart from each other by at least 2 millimeters.

In an eighth embodiment, the invention provides the wet wipe of any of the first through seventh embodiments wherein the first binder and second binder have the same chemical composition.

In a ninth embodiment, the invention provides the wet wipe of any of the first through eighth embodiments, the first binder further applied in a coating on the second surface, wherein the coating comprises randomly distributed deposits of the first binder, and the second binder further applied in an intermittent pattern on the second surface to define first regions on the second surface that include first binder but no second binder and to define second regions on the second surface that include both first binder and second binder.

In a tenth embodiment, the invention provides the wet wipe of any of the first or third through ninth embodiments wherein the layer of cellulosic fibers comprises a wetlaid tissue, and does not include an airlaid sub-layer.

In an eleventh embodiment, the invention provides a dispersible wet wipe that includes a layer of cellulosic fibers, the layer having a first surface and a second surface. A first binder is applied to the first surface in a continuous and pattern-less coating. A second binder is applied to the first surface in a discontinuous pattern to define first regions on the first surface that include first binder but no second binder and to define second regions on the first surface that include both first binder and second binder.

In a twelfth embodiment, the invention provides the wet wipe of the eleventh embodiment wherein the layer of cellulosic fibers comprises a first sub-layer of wetlaid tissue and a second sub-layer of airlaid tissue.

In a thirteenth embodiment, the invention provides the wet wipe of either the eleventh or twelfth embodiment wherein the coating is a spray coating.

In a fourteenth embodiment, the invention provides the wet wipe of any of the eleventh through thirteenth embodiments wherein the discontinuous pattern is a lattice pattern.

In a fifteenth embodiment, the invention provides the wet wipe of any of the eleventh through fourteenth embodiments wherein the discontinuous pattern comprises continuous lines of second binder that extend in a primarily cross-machine direction, and wherein the discontinuous pattern does not comprise continuous lines of second binder that extend in a primarily machine direction.

In a sixteenth embodiment, the invention provides the wet wipe of any of the eleventh through fifteenth embodiments wherein the first binder and second binder have the same chemical composition.

In a seventeenth embodiment, the invention provides the wet wipe of any of the eleventh through sixteenth embodiments, the first binder further applied to the second surface in a continuous and pattern-less coating, and the second binder further applied to the second surface in a discontinuous pattern to define first regions on the second surface that include first binder but no second binder and to define second regions on the second surface that include both first binder and second binder.

In an eighteenth embodiment, the invention provides a dispersible wet wipe that includes a layer of cellulosic fibers, the layer having a first surface having a first surface area and a second surface having a second surface area. A first binder is applied to the first surface to define a first binder surface area. A second binder is applied to the first surface to define a second binder surface area. The second binder surface area is at most 50 percent of the first binder surface area.

In a nineteenth embodiment, the invention provides the wet wipe of the eighteenth embodiment wherein the layer of cellulosic fibers comprises a first sub-layer of wetlaid tissue and a second sub-layer of airlaid tissue.

In a twentieth embodiment, the invention provides the wet wipe of either the eighteenth or nineteenth embodiments wherein the second binder surface area is at most 10 percent of the first binder surface area.

In a twenty-first embodiment, the invention provides the wet wipe of any of the eighteenth through twentieth embodiments wherein the first binder surface area is 100 percent of the first surface area.

In a twenty-second embodiment, the invention provides the wet wipe of any of the eighteenth through twenty-first embodiments wherein the second binder is applied in a lattice pattern.

In a twenty-third embodiment, the invention provides the wet wipe of any of the eighteenth through twenty-second embodiments wherein the first binder and second binder have the same chemical composition.

In a twenty-fourth embodiment, the invention provides the wet wipe of any of the eighteenth through twenty-third embodiments, the first binder further applied to the second surface to define a second surface first binder surface area, and the second binder further applied to the second surface to define a second surface second binder surface area, wherein the second surface second binder surface area is at most 10 percent of the second surface first binder surface area.

In a twenty-fifth embodiment, a dispersible wet wipe includes a web having first and second surfaces. A first binder is disposed in a first pattern on the first surface. A second binder is disposed in a second pattern on the first surface, the second pattern having first and second regions. The second regions comprise both first and second binder and the first regions are substantially free of the first binder.

In a twenty-sixth embodiment, the invention provides the wet wipe of the twenty-fifth embodiment wherein the web comprises cellulosic fibers.

In a twenty-seventh embodiment, the invention provides the wet wipe of either the twenty-fifth or the twenty-sixth embodiments wherein the web comprises a first and a second layer.

In a twenty-eighth embodiment, the invention provides the wet wipe of the twenty-seventh embodiment wherein the first and second layers are manufactured by different processes.

In a twenty-ninth embodiment, the invention provides the wet wipe of the twenty-eighth embodiment wherein the first layer is wetlaid and the second layer is airlaid.

In a thirtieth embodiment, the invention provides the wet wipe of any of the twenty-fifth through twenty-ninth embodiments wherein the first binder covers at least about 70 percent of a first surface area of the first surface.

In a thirty-first embodiment, the invention provides the wet wipe of the thirtieth embodiment wherein the second binder covers at most about 10 percent of the first surface area.

In a thirty-second embodiment, the invention provides the wet wipe of any of the twenty-fifth through thirty-first embodiments wherein the first pattern comprises randomly distributed deposits of first binder.

In a thirty-third embodiment, the invention provides the wet wipe of any of the twenty-fifth through thirty-second embodiments wherein the first pattern is a random pattern.

In a thirty-fourth embodiment, the invention provides the wet wipe of any of the twenty-fifth through thirty-second embodiments wherein the first pattern is a non-random pattern.

In a thirty-fifth embodiment, the invention provides the wet wipe of any of the twenty-fifth through thirty-fourth embodiments wherein the second pattern comprises a substantially continuous lattice pattern.

In a thirty-sixth embodiment, the invention provides a dispersible wet wipe that includes a web having first and second surfaces. A binder is disposed in a pattern having first regions and second regions, and the add-on level of the binder in the first regions is lower than the add-on level of the binder in the second regions. The first regions comprise islands separated by second regions.

In a thirty-seventh embodiment, the invention provides a method of making a dispersible wet wipe. The method includes providing a web of cellulosic fibers, the web having a first surface and second surface; applying a first binder to the first surface in a coating, wherein the coating comprises randomly distributed deposits of the first binder; and applying a second binder in an intermittent pattern on the first surface to define first regions on the first surface that include first binder but no second binder and to define second regions on the first surface that include both first binder and second binder.

In a thirty-eighth embodiment, the invention provides the method of the thirty-seventh embodiment wherein the first binder is sprayed onto the first surface and wherein the second binder is not sprayed onto the first surface.

In a thirty-ninth embodiment, the invention provides the method of either the thirty-seventh or thirty-eighth embodiment wherein the intermittent pattern is a roll-printed pattern.

In a fortieth embodiment, the invention provides the method of any of the thirty-seventh through thirty-ninth embodiments wherein the intermittent pattern is a lattice pattern.

In a forty-first embodiment, the invention provides the method of any of the thirty-seventh through fortieth embodiments wherein the first binder and the second binder have the same chemical composition.

In a forty-second embodiment, the invention provides the method of any of the thirty-seventh through forty-first embodiments wherein the first binder is applied in full before the second binder is applied.

In a forty-third embodiment, the invention provides the method of the forty-second embodiment wherein the web of cellulosic fibers is wound into a roll and then unwound from the roll, after applying the first binder but before applying the second binder.

In a forty-fourth embodiment, the invention provides the method of either the forty-second or forty-third embodiment further comprising heat curing the first binder in a first curing step after applying the first binder but before applying the second binder.

In a forty-fifth embodiment, the invention provides the method of the forty-fourth embodiment further comprising heat curing the second binder in a second curing step after applying the second binder.

In a forty-sixth embodiment, the invention provides the method of any of the thirty-seventh through forty-first embodiments wherein the second binder is applied in full before the first binder is applied.

In a forty-seventh embodiment, the invention provides the method of the forty-sixth embodiment wherein the web of cellulosic fibers is wound into a roll and then unwound from the roll, after applying the second binder but before applying the first binder.

In a forty-eighth embodiment, the invention provides the method of either the forty-sixth or forty-seventh embodiment further comprising heat curing the second binder in a first curing step after applying the second binder but before applying the first binder.

In a forty-ninth embodiment, the invention provides the method of the forty-eighth embodiment further comprising heat curing the first binder in a second curing step after applying the first binder.

In a fiftieth embodiment, the invention provides the method of any of the thirty-seventh through forty-ninth embodiments further comprising applying the first binder in a coating on the second surface, wherein the coating comprises randomly distributed deposits of the first binder, and further comprising applying the second binder in an intermittent pattern on the second surface to define first regions on the second surface that include first binder but no second binder and to define second regions on the second surface that include both first binder and second binder.

In a fifty-first embodiment, the invention provides a method of making a dispersible wet wipe. The method includes providing a web of cellulosic fibers, the web having a first surface and second surface; applying a first binder to the first surface in a first pattern; and, after applying the first binder to the first surface, applying a second binder to the first surface in a second pattern that is different than the first pattern.

In a fifty-second embodiment, the invention provides the method of the fifty-first embodiment wherein the first pattern covers a first binder surface area, and the second pattern covers a second binder surface area that is at most 10 percent of the first binder surface area.

In a fifty-third embodiment, the invention provides the method of the fifty-second embodiment wherein the first surface has a first surface area and wherein the first binder surface area is 100 percent of the first surface area.

In a fifty-fourth embodiment, the invention provides the method of the fifty-first embodiment wherein the second pattern covers a second binder surface area, and the first pattern covers a first binder surface area that is at most 10 percent of the second binder surface area.

In a fifty-fifth embodiment, the invention provides the method of the fifty-fourth embodiment wherein the first surface has a first surface area and wherein the second binder surface area is 100 percent of the first surface area.

In a fifty-sixth embodiment, the invention provides the method of any of the fifty-first through the fifty-fifth embodiments wherein the first binder is sprayed onto the first surface and wherein the second binder is not sprayed onto the first surface.

In a fifty-seventh embodiment, the invention provides the method of any of the fifty-first through the fifty-sixth embodiments wherein the second pattern is a roll-printed pattern.

In a fifty-eighth embodiment, the invention provides the method of any of the fifty-first through the fifty-seventh embodiments wherein the web of cellulosic fibers is wound into a roll and then unwound from the roll, after the first binder is applied but before second binder is applied.

In a fifty-ninth embodiment, the invention provides the method of any of the fifty-first through the fifty-eighth embodiments further comprising heat curing the first binder in a first curing step after applying the first binder but before applying the second binder.

In a sixtieth embodiment, the invention provides the method of the fifty-ninth embodiment further comprising heat curing the second binder in a second curing step after applying the second binder.

In a sixty-first embodiment, the invention provides the method of any of the fifty-first through sixtieth embodiments further comprising applying the first binder in a coating on the second surface, wherein the coating comprises randomly distributed deposits of the first binder, and further comprising applying the second binder in an intermittent pattern on the second surface to define first regions on the second surface that include first binder but no second binder and to define second regions on the second surface that include both first binder and second binder.

In a sixty-second embodiment, the invention provides a method of making a dispersible wet wipe. The method includes providing a web of cellulosic fibers, the web having a first surface and second surface; and applying a binder to the first surface in a pattern, the pattern having first regions and second regions, wherein the add-on level of the binder in the first regions is lower than the add-on level of the binder in the second regions.

In a sixty-third embodiment, the invention provides the method of the sixty-second embodiment, the first regions comprising islands separated by second regions.

In a sixty-fourth embodiment, the invention provides the method of either the sixty-second or sixty-third embodiment wherein the pattern is a roll-printed pattern.

In a sixty-fifth embodiment, the invention provides the method of any of the sixty-second through sixty-fourth embodiments wherein the first regions define a first region surface area and the second regions define a second region surface area, wherein the second region surface area is at most 20 percent of the first region surface area.

DETAILED DESCRIPTION OF PARTICULAR EMBODIMENTS

Figure 1:
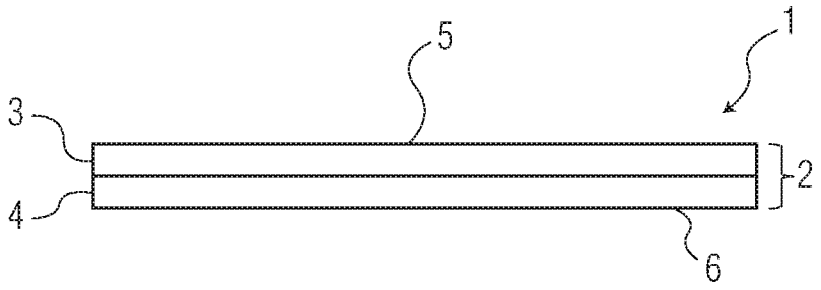
FIG. 1 is a side view of one embodiment of the dispersible wet wipe of the present invention, with its thickness exaggerated to show detail.

The present disclosure generally relates to dispersible wet wipes. In particular embodiments, a wipe 1 comprises a layer 2 of cellulosic fibers, such as a layer of tissue having a basis weight of between 40 and 100 grams per square meter. Optionally, the substrate can have two sub-layers, such as a first sub-layer 3 and a second sub-layer 4. The first sub-layer 3 is superposed over the second sub-layer 4, and the first sub-layer 3 is adhered to the second sub-layer 4. Such adherence can be provided, for example, via embossing, via adhesive, via hydrogen bonding, via fiber entangling, via pressure, and/or via the use of one or more binders. Both the first and second sub-layers 3, 4 comprise cellulosic fibers. Preferably, all of the fibers of both layers are cellulosic fibers. Examples of suitable cellulosic fibers include softwood fibers, hardwood fibers, regenerated cellulosic fibers, and the like.

In particular embodiments, the first sub-layer 3 comprises a wetlaid tissue. Examples of suitable wetlaid tissue include those made by uncreped through-air dried ("UCTAD"), creped through-air dried ("CTAD"), and modified wet-press processes, all of which are known in the art. Exemplary processes to prepare uncreped through-air dried tissue suitable for use in conjunction with the present invention are described in U.S. Pat. Nos. 5,607,551, 5,672,248, 5,593,545, 6,083,346 and 7,056,572, all herein incorporated by reference to the extent consistent herewith.

In particular embodiments, the second sub-layer 4 is a nonwoven web. The term "nonwoven web" as used herein means a structure of fibers randomly formed in a mat-like fashion without the use of an aqueous slurry, in contrast to a wet-laid tissue. Examples of suitable nonwoven webs include meltblown, spunbond, airlaid, bonded-carded web materials, hydroentangled materials, spunlace materials, and combinations thereof. Such materials can be comprised of synthetic or natural fibers, or a combination thereof. One exemplary process to prepare airlaid materials suitable for use in conjunction with the present invention is described in U.S. Pat. No. 8,603,297, herein incorporated by reference to the extent consistent herewith. Preferably, the second sub-layer 4 comprises a cellulosic airlaid layer. In particular embodiments, the first sub-layer can comprise a nonwoven web (such as an airlaid web), and the second sub-layer can comprise a wetlaid tissue. Alternatively, both sub-layers can comprise the same type of web or tissue.

Figure 2:
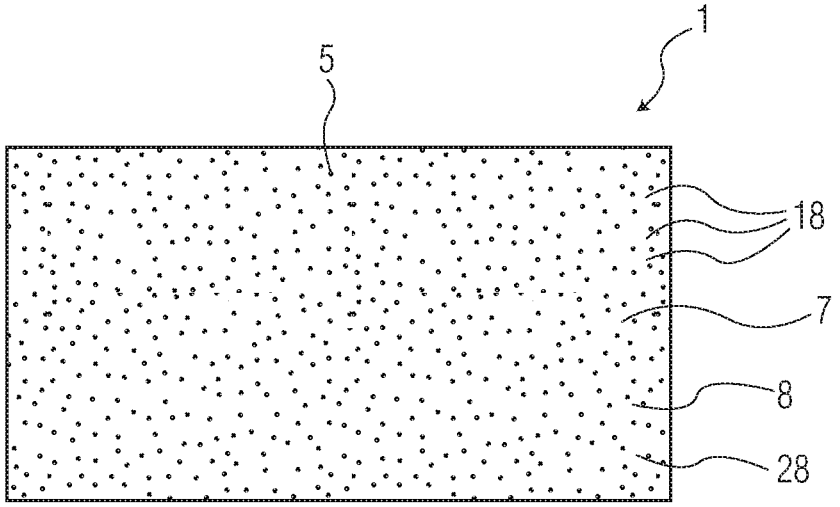
FIG. 2 is a top plan view of one embodiment of a dispersible wet wipe suitable for use in conjunction with particular embodiments of the present invention.
Figure 5:
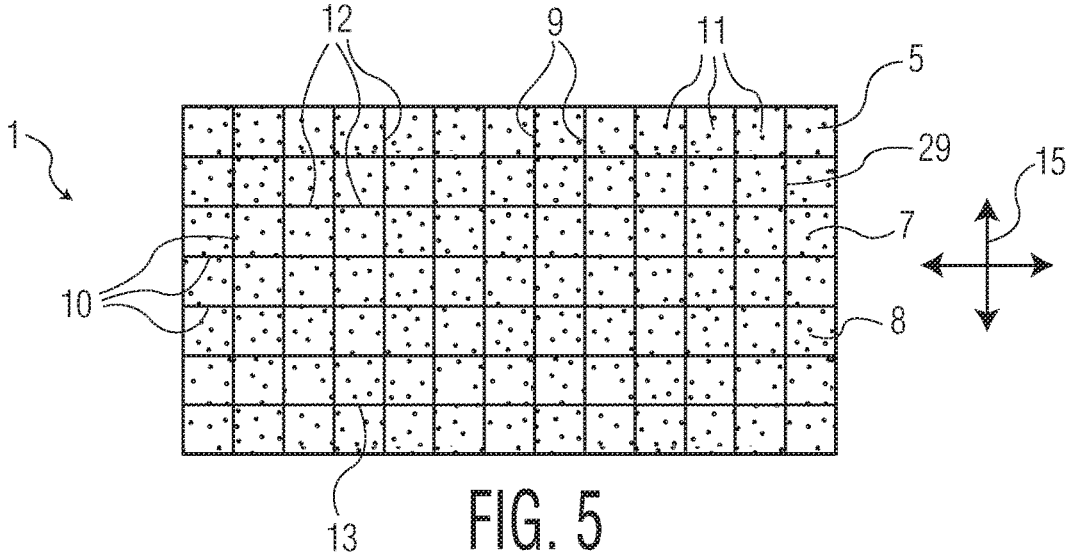
FIG. 5 is a top plan view of another embodiment of the dispersible wet wipe of the present invention.

The layer 2 of the dispersible wet wipe 1 has a first surface 5 and a second surface 6. A first binder 7 is applied in a coating 8 on the first surface 5. In particular embodiments, the coating 8 comprises randomly distributed deposits 18 of the first binder 7. "Randomly distributed deposits" as used herein means that the elements of binder that form the coating are applied without any predetermined pattern, but are instead randomly applied in a continuous, uninterrupted operation, such as via a continuous mist spray, a continuous rotary print coater, a continuous brush coater, or the like. It is understood that at a microscopic level, the deposits of binder may have space between them; "randomly distributed deposits" is meant to distinguish from, for example, an application have a distinct, predetermined, repeating pattern that is visible to the naked eye, such as shall be described below with respect to a different binder application. In the example of FIGS. 2 and 5, the coating 8 has been applied in randomly distributed deposits. In one embodiment, the coating is a spray coating.

Figure 3:
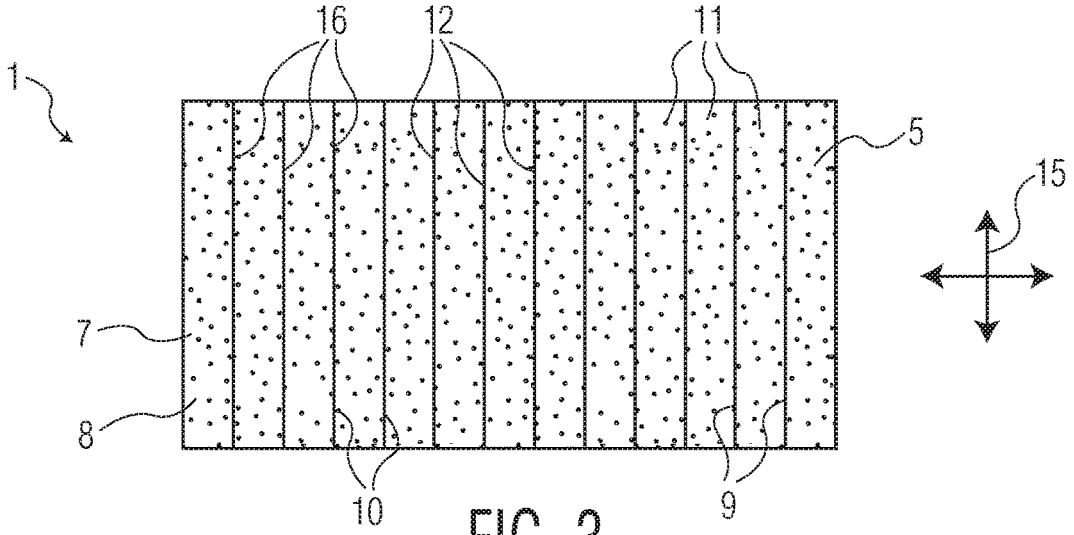
FIG. 3 is a top plan view of one embodiment of the dispersible wet wipe of the present invention.
Figure 4:
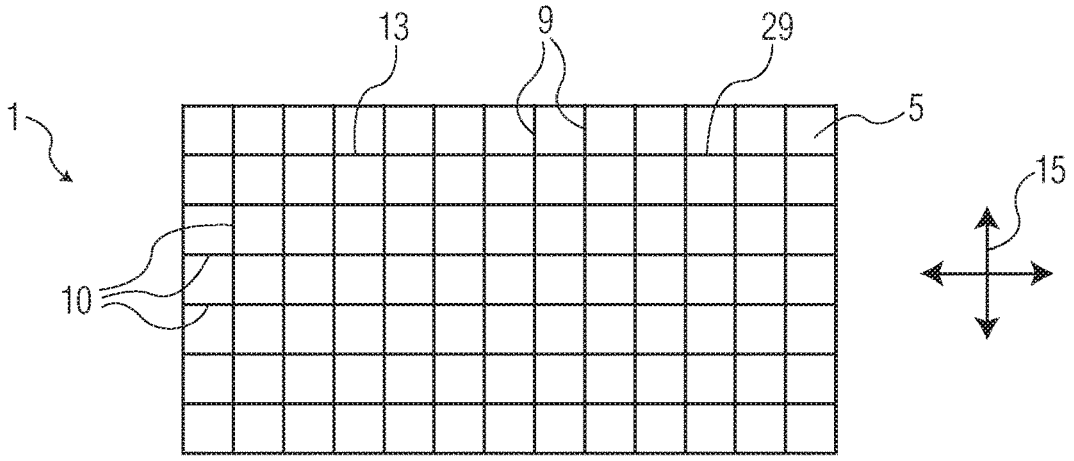
FIG. 4 is a top plan view of another embodiment of a dispersible wet wipe suitable for use in conjunction with particular embodiments of the present invention.

A second binder 9 is applied in an intermittent pattern 10 on the first surface 5. FIGS. 3-5 show examples of such embodiments. In particular embodiments, the intermittent pattern 10 defines first regions 11 on the first surface 5 that include first binder 7 but no second binder 9 and defines second regions 12 on the first surface 5 that include both first binder 7 and second binder 9. In particular embodiments, the intermittent pattern 10 is a roll-printed pattern. "Intermittent" with respect to a particular pattern means applied in a manner such that regions that include the binder alternate with regions that don't include the binder. In particular embodiments, the intermittent pattern 10 is a lattice pattern 13. Examples of suitable intermittent patterns include an acorn pattern, a honeycomb pattern, a bow-tie pattern, a hound's tooth pattern, a herringbone pattern, a chessboard pattern, and the like.

Referring to FIG. 3, in particular embodiments the intermittent pattern 10 comprises continuous, optionally parallel lines 16 of second binder 9 that extend in a primarily cross-machine direction 15, and the intermittent pattern 10 does not include continuous lines of second binder that extend in a primarily machine direction. "Primarily" as used to describe the direction of lines of binder means that the lines on average slope or extend more in one direction than the other. "Machine direction" and "cross-machine direction" refer to the process in which the tissue or nonwoven web was created, prior to being printed with binder.

In particular embodiments, a first binder 7 is also applied in a coating on the second surface 6 (not shown). As with the coating 8 on the first surface, 5, the coating on the second surface 6 can comprise randomly distributed deposits of the first binder 7, such as again a spray coating. A second binder 9 can also be applied in an intermittent pattern on the second surface 6 (not shown). As with the intermittent pattern applied to the first surface 5, the intermittent pattern on the second surface 6 can define first regions that include first binder 7 but no second binder 9 and define second regions 12 that include both first binder 7 and second binder 9.

In particular embodiments, the coating 8 is continuous and pattern-less (as representatively illustrated in FIG. 2), and the second binder 9 is applied to the first surface 5 in a discontinuous pattern 10 to define first regions 11 on the first surface 5 that include first binder 7 but no second binder 9 and to define second regions 12 on the first surface 5 that include both first binder 7 and second binder 9. An example of a "continuous" coating is a mist spray coating; on a microscopic level, the deposits of binder within the coating may have space between them, but on a macroscopic level, one of skill in the art understands that a continuously applied mist spray coating is a "continuous" coating, as representatively illustrated in FIG. 2. "Discontinuous" with respect to a particular pattern means applied in a manner such that regions to which the binder was applied alternate with regions to which the binder was not applied. Example of suitable discontinuous patterns include an acorn pattern, a honeycomb pattern, a bow-tie pattern, a hound's tooth pattern, a herringbone pattern, a chessboard pattern, and the like.

In particular embodiments, the first surface 5 has first surface area, and the second surface 6 has a second surface area. The first binder 7 is applied to the first surface 5 to define a first binder surface area, and the second binder 9 is applied to the first surface 5 to define a second binder surface area. "Binder surface area" as used herein means the area bounded by the cumulative footprint upon which the binder is applied, without regard to the microscopic space between individual deposits of binder. In particular embodiments, the first binder surface area is 100 percent of the first surface area. For example, in the example of FIG. 5, the first binder surface area is approximately 100 percent, because the first binder 7 is applied continuously over the entire first surface area of the first surface. The second binder surface area is the surface area of the lines of the intermittent pattern 10. In particular embodiments, the second binder surface area is at most 50 percent, at most 25 percent, at most 12.5 percent, or at most 10 percent of the first binder surface area. In particular embodiments, the first binder 7 is further applied to the second surface 6 to define a second surface first binder surface area. In particular embodiments, the second binder 9 is further applied to the second surface 6 to define a second surface second binder surface area, and the second surface second binder surface area is at most 50 percent, at most 25 percent, at most 12.5 percent, or at most 10 percent of the second surface first binder surface area.

In particular embodiments, the first binder 7 and the second binder 9 have the same chemical composition. In other embodiments, the first binder 7 and the second binder 9 have different chemical compositions. In certain embodiments, the first binder 7 and the second binder 9 have the same chemical composition, but have different concentration levels. One suitable binder includes a water-dilution triggerable polymer. Particular embodiments of dilution triggerable polymers include ion-sensitive polymers. If the ion-sensitive polymer is derived from one or more monomers, where at least one monomer contains an anionic functionality, the ion-sensitive polymer is referred to as an anionic ion-sensitive polymer. If the ion-sensitive polymer is derived from one or more monomers, where at least one monomer contains a cationic functionality, the ion-sensitive polymer is referred to as a cationic ion-sensitive polymer. An exemplary anionic ion-sensitive polymer is described in U.S. Pat. No. 6,423,804, which is incorporated herein in its entirety by reference. An example of a suitable binder composition is disclosed in U.S. Pat. No. 6,994,865, hereby incorporated by reference in its entirety. Another suitable binder is a carboxymethyl cellulose ("CMC") material. CMC materials are available from Ashland, under the trade name Aqualon™.

The wipe further includes a wetting solution. The wetting solution includes in particular embodiments a first insolubilizing agent, and optionally also includes a second insolubilizing agent. Desirably, the binders are insoluble (stable) in the presence of the wetting solution containing one or more insolubilizing agents. In other words, the one or more insolubilizing agents render stable the first binder, the second binder, or both, prior to the wipe being flushed into a toilet or otherwise contacted by tap water. "Stable" as used herein means continuing to hold the fibers of the wipe together as intended for use of the wipe.

For example, a CMC binder is insoluble (stable) in the presence of multivalent cations, such as $Ca^{2+}$, $Cu^{2+}$, $Fe^{2+}$, $Sn^{2+}$, $Fe^{3+}$ or $Al^{3+}$, and organic solvents, such as water-compatible (or water-soluble) solvents typically including monohydric lower alcohols such as ethanol, methanol, and propanol; glycols such as ethylene glycol, diethylene glycol, polyethylene glycol, propylene glycol, dipropylene glycol, butylene glycol and hexylene glycol; mono- or diethers of the aforementioned glycols and lower alcohols such as methanol, ethanol and butanol; esters of the aforementioned glycols and lower fatty acids; and polyhydric alcohols such as glycerine and sorbitol.

In other examples, binders employing ion-sensitive polymers are desirably insoluble in a wetting solution that includes at least about 0.3 and more particularly from about 0.5 to about 3.5 weight percent of an insolubilizing agent comprised of one or more inorganic and/or organic salts containing monovalent and/or divalent ions. Suitable monovalent ions include, for example, $Na^+$ ions, $K^+$ ions, $Li^+$ ions, $NH_4^+$ ions, low molecular weight quaternary ammonium compounds (e.g., those having fewer than 5 carbons on any side group), and a combination thereof. Suitable divalent ions include, for example, $Zn^{2+}$, $Ca^{2+}$ and $Mg^{2+}$. These monovalent and divalent ions may be derived from organic and inorganic salts, such as NaCl, NaBr, KCl, $NH_4Cl$, $Na_2SO_4$, $ZnCl_2$, $CaCl_2$), $MgCl_2$, $MgSO_4$, and combinations thereof. Typically, alkali metal halides are the most desirable monovalent or divalent ions because of cost, purity, low toxicity, and availability. In another preferred embodiment, the ion-sensitive polymer may comprise a cationic sensitive polymer, wherein the cationic sensitive polymer is a cationic polyacrylate that is the polymerization product of 92 mol % methyl acrylate, 4 mol % hydroxypropyl acrylate and 4 mol % [2-(acrylolyoxy)ethyl]trimethyl ammonium chloride. Other insolubilizing agents, such as organic or polymeric compounds, can be used.

The liquid wetting solution can be any liquid that can be absorbed into the wipe substrate and may include any suitable components that provide the desired wiping properties. For example, the solution may include water, emollients, surfactants, fragrances, preservatives, organic or inorganic acids, chelating agents, pH buffers, or combinations thereof, as are well known to those skilled in the art. Further, the wetting solution may also contain lotions, medicaments, and/or antimicrobials. The wetting solution may contain additional agents that impart a beneficial effect on skin or hair and/or further act to improve the aesthetic feel of the compositions and wipes described herein. Examples of suitable skin benefit agents include emollients, sterols or sterol derivatives, natural and synthetic fats or oils, viscosity enhancers, rheology modifiers, polyols, surfactants, alcohols, esters, silicones, clays, starch, cellulose, particulates, moisturizers, film formers, slip modifiers, surface modifiers, skin protectants, humectants, sunscreens, and the like.

The wetting solution may be incorporated into the wipe in an add-on amount of from about 10 to about 600 percent, more desirably from about 100 to about 500 percent, and even more desirably from about 200 to about 300 percent of the dry weight of the substrate. In one example, the wetting solution contains water. The wetting solution can in particular embodiments contain water in an amount of from about 40 to about 99 percent of the total weight of the solution.

The dispersible wet wipe of particular embodiments of the present invention has a cross-machine direction wet tensile strength ("CDWT") of greater than 200 grams, more particularly greater than 225 grams, and more particularly great than 250 grams per linear inch. Having a CDWT strength in this range can help prevent the wipe from tearing during dispensing or during personal hygiene use. In particular embodiments, the wipe has a CDWT after soaking for 15 minutes in room temperature tap water of less than 125, and more particularly less than 100, grams per linear inch. In particular embodiments, the wipe preferably has a 60-min post-soak CDWT of less than 80, and more preferably less than 65, grams per linear inch. Having a post-soak CDWT in this range bears on the wipe's ability to lose strength and break down in wastewater conveyance infrastructure after flushing, as the minimum time that a wipe would reside in a home drain line after being flushed is 15 minutes (although typically wipes reside in the home drain line longer than 15 minutes). In particular embodiments, the dispersible wet wipe of particular embodiments of the present invention has a Slosh-Box Break-Up Time of less than 130 minutes, or more particularly less than 90 minutes, in accordance with the test procedure set forth below.

In another aspect, the present invention relates to a method 40 of making a dispersible wet wipe. The method includes providing a web 42 of cellulosic fibers. The web 42 has a first surface 45 and second surface 46. In particular embodiments, the method includes applying a first binder 7 to the first surface 45 in a coating 8 by an applicator 57, such that the coating 8 comprises randomly distributed deposits of the first binder 7. The embodiment also includes applying a second binder 9 in an intermittent pattern 10 on the first surface 45 by an applicator 59 to define first regions 11 on the first surface 45 that include first binder 7 but no second binder 9 and to define second regions 12 on the first surface 45 that include both first binder 7 and second binder 9. The intermittent pattern 10 may by applied, for example, in any of the suitable intermittent patterns described above. In particular embodiments, the first binder 7 and the second binder 9 have the same chemical composition. In other embodiments, the first binder 7 and the second binder 9 have different chemical compositions. In certain embodiments, the first binder 7 and the second binder 9 have the same chemical composition, but have different concentration levels.

Figure 6:
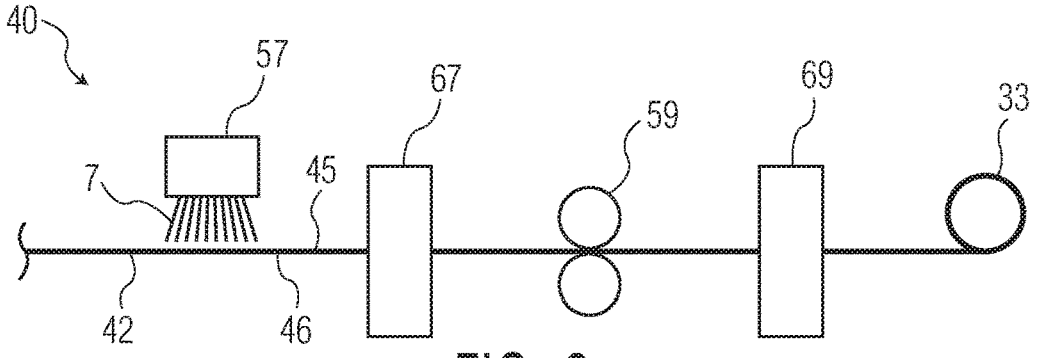
FIG. 6 is a side view showing stages of one embodiment of the method of the present invention.
Figure 7:
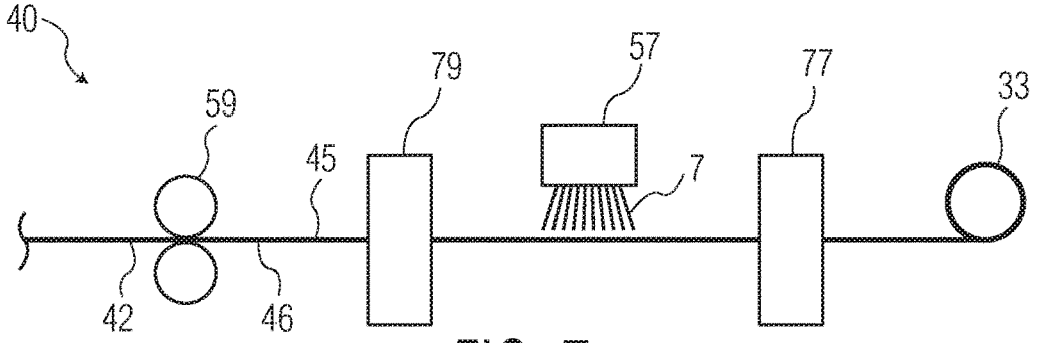
FIG. 7 is a side view showing stages of another embodiment of the method of the present invention.

In particular embodiments, such as those depicted in FIGS. 6-8, the first binder 7 is sprayed onto the first surface 45, and the second binder 9 is not sprayed onto the first surface. Even where the first binder 7 and the second binder 9 have the same chemical composition, and perhaps even the same level of concentration prior to application, there can be advantages to applying the first and second binders in two separate steps and by two different application techniques. Without wishing to limit the scope of the invention, it is believed that by applying one stage of binder in a low-level, "all over" coating, and another stage of binder in a pattern having repeating gaps therein, an optimal balance between in-use strength and good post-flush dispersibility can be struck. To borrow a concrete construction analogy, the "all over" binder functions as "cement" upon the surface of the substrate, and the intermittent pattern of binder functions as "reinforcing bar" upon the surface of the substrate.

Figure 9A:
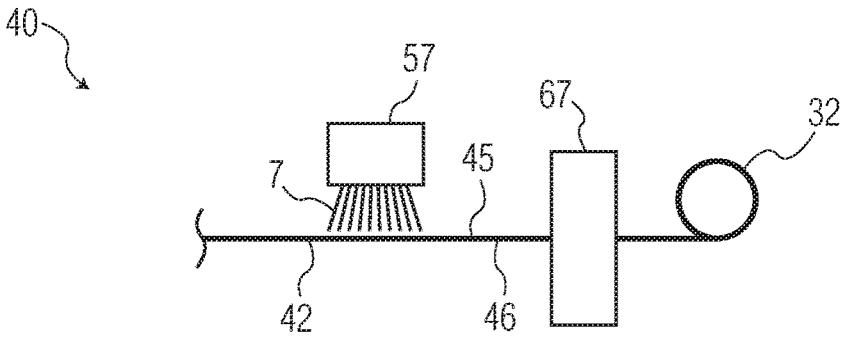
FIGS. 9A and 9B are side views showing stages of still another embodiment of the method of the present invention.
Figure 9B:
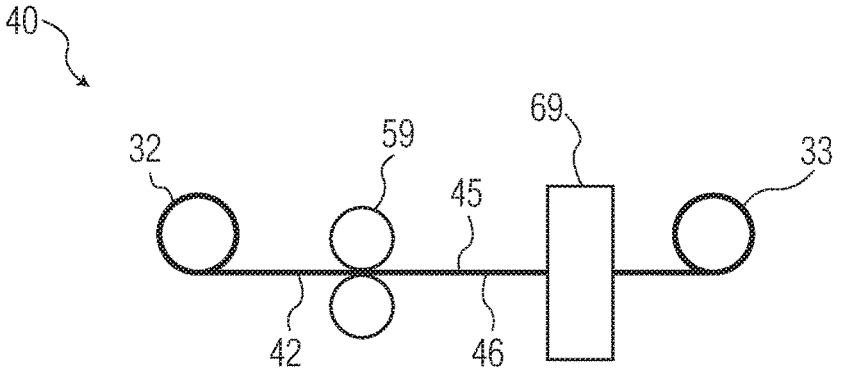

In particular embodiments, such as that depicted in FIG. 6, the first binder 7 is applied in full before the second binder 9 is applied. Optionally, as shown in FIG. 9, the web 42 of cellulosic fibers is wound into a roll 32 (FIG. 9A) and then unwound from the roll 32 (FIG. 9B), after applying the first binder 7 via application 57 but before applying the second binder 9 via applicator 59. In particular embodiments, referring to FIGS. 6 and 9, the method includes heat curing the first binder 7 in a first curing step 67 after applying the first binder 7 but before applying the second binder 9. Still referring to FIGS. 6 and 9, such embodiments can further include heat curing the second binder 9 in a second curing step 69 after applying the second binder 9. In particular embodiments, the first curing step 67 and the second curing step 69 occur at temperatures that are different by at least 10 degrees, or at least 20 degrees F. In particular embodiments, the first curing step 67 lasts at least 50 percent, more particularly at least 100 percent, and still more particularly at least 200 percent longer than the second curing step 69. For example, in one embodiment, the first curing step 67 lasts for 12 seconds, and the second curing step 69 lasts for 5 seconds. Alternatively, in particular embodiments, the second curing step 69 lasts at least 50 percent, more particularly at least 100 percent, and still more particularly at least 200 percent longer than the first curing step 67.

Figure 8A:
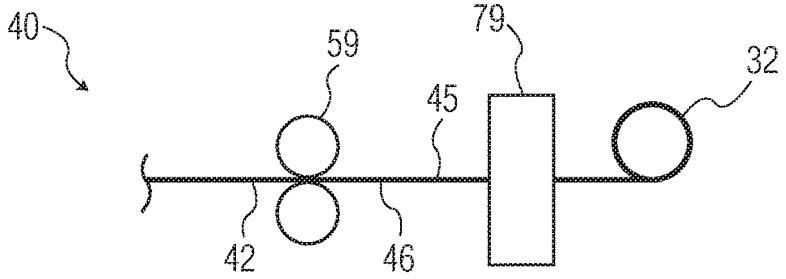
FIGS. 8A and 8B are side views showing stages of yet another embodiment of the method of the present invention.
Figure 8B:
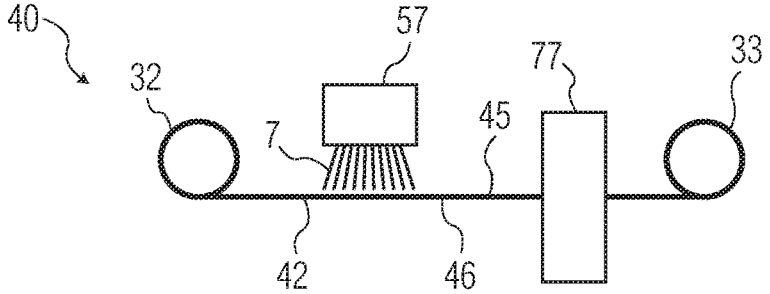

In other embodiments, such as that depicted in FIG. 8, the second binder 9 is applied in full before the first binder 7 is applied. Optionally, as shown in FIG. 8, the web 42 of cellulosic fibers is wound into a roll 32 (FIG. 8A) and then unwound from the roll 32 (FIG. 8B), after applying the second binder 9 via applicator 59 but before applying the first binder 7 via applicator 57. In particular embodiments, referring to FIGS. 7 and 8, the method includes heat curing the second binder 9 in a first curing step 79 after applying the second binder 9 but before applying the first binder 7. Still referring to FIGS. 7 and 8, such embodiments can further include heat curing the first binder 7 in a second curing step 77 after applying the first binder 7. In particular embodiments, the first curing step 79 and the second curing step 77 occur at temperatures that are different by at least 10 degrees, or at least 20 degrees F. In particular embodiments, the first curing step 79 lasts at least 50 percent, more particularly at least 100 percent, and still more particularly at least 200 percent longer than the second curing step 77. For example, in one embodiment, the first curing step 79 lasts for 12 seconds, and the second curing step 77 lasts for 5 seconds. Alternatively, in particular embodiments, the second curing step 77 lasts at least 50 percent more particularly at least 100 percent, and still more particularly at least 200 percent longer than the first curing step 79.

After all binder application stages and all curing stages, the web can optionally be wound into a roll 33, for subsequent converting into individual wet wipes.

Referring to FIGS. 6 and 7, in particular embodiments, the first binder 7 is applied by applicator 57 and the second binder 9 is applied by applicator 59 in a single continuous binder application process, after which the web 42 is wound into a roll 33.

In particular embodiments, a first binder 7 is also applied in a coating on the second surface 46. As with the coating 8 on the first surface 45, the coating on the second surface 46 can comprise randomly distributed deposits of the first binder 7, such as again a spray coating. A second binder 9 can also be applied in an intermittent pattern on the second surface 46. As with the intermittent pattern applied to the first surface 45, the intermittent pattern on the second surface 46 can define first regions that include first binder 7 but no second binder 9 and define second regions that include both first binder 7 and second binder 9.

In particular embodiments, the method 40 includes providing a web 42 of cellulosic fibers. The web 42 has a first surface 45 and second surface 46. The method includes applying a first binder 7 to the first surface 45 in a first pattern 28 (FIG. 2), and, after applying the first binder 7 to the first surface 45, applying a second binder 9 to the first surface 45 in a second pattern 29 (FIG. 5) that is different than the first pattern 28. The first pattern 28 covers a first binder surface area, and the second pattern 29 covers a second binder surface area. In particular embodiments, the second binder surface area is at most 50 percent, more particularly at most 25 percent, still more particularly, at most 12.5 percent, and still more particularly at most 10 percent, of the first binder surface area. In other embodiments, the first binder surface area is at most 50 percent, more particularly at most 25 percent, still more particularly at most 12.5 percent, and still more particularly at most 10 percent, of the second binder surface area.

Figure 10:
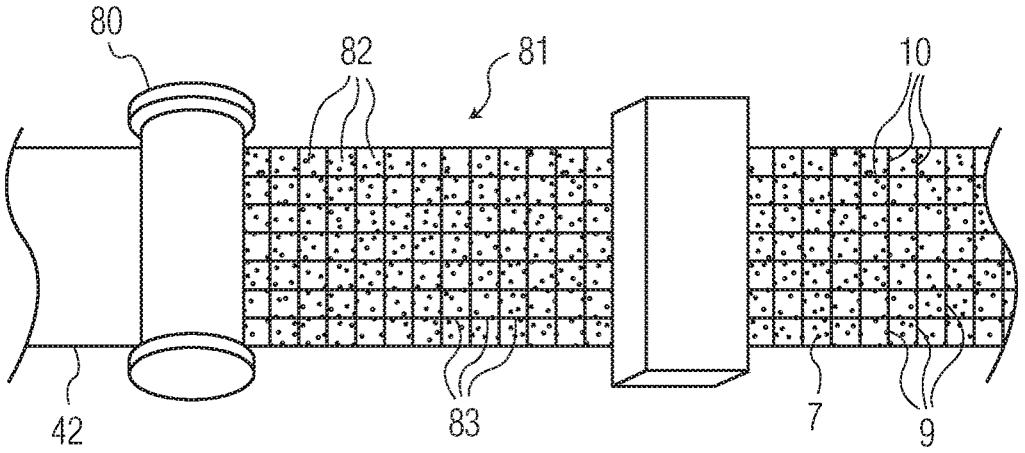
FIG. 10 is a top perspective view showing stages of yet another embodiment of the method of the present invention.

Referring to FIG. 10, in particular embodiments, a binder is applied at a single binder application station 80 in a pattern 81. The pattern 81 includes first regions 82 that include binder 7 at a first add-on level, and second regions 83 that include binder 7 at a second add-on level. The first add-on level is lower than the second add-on level. In particular embodiments, the first add-on level is at most 75 percent, at most 50 percent, or at most 25 percent of the second add-on level.

TEST METHODS

Tensile Strength

For purposes herein, tensile strength may be measured using a Constant Rate of Elongation (CRE) tensile tester using a 1-inch jaw width (sample width), a test span of 3 inches (gauge length), and a rate of jaw separation of 25.4 centimeters per minute after maintaining the sample at the ambient conditions of 23±2 degrees Celsius and 50±5 percent relative humidity for four hours before testing the sample at the same ambient conditions. The wet wipes are cut into 1-inch wide by 5.5 inches long strips cut from the center of the wipes in the cross-machine direction (CD) orientation. The "cross-machine direction wet tensile strength" ("CDWT") is the peak load in grams-force per inch of sample width when a specimen is pulled to rupture in the cross-machine direction.

The instrument used for measuring tensile strength was an MTS Systems Sinergie 200 model. The data acquisition software was MTS TestWorks® for Windows Ver. 4.0 commercially available from MTS Systems Corp., Eden Prairie, Minn. The load cell was an MTS 50 Newton maximum load cell. The gauge length between jaws is 3 inches. The top and bottom jaws are operated using pneumatic-action with maximum 80 P.S.I. The break sensitivity is set at 40 percent. The data acquisition rate is set at 100 Hz (i.e., 100 samples per second). The sample is placed in the jaws of the instrument, centered both vertically and horizontally. The test is then started and ended when the force drops by 40 percent of peak. The peak load expressed in grams-force is recorded as the "CDWT" of the specimen. Eight representative specimens were tested for each product and the average peak load determined.

To simulate post-flush tensile strength measurements, five specimens are flushed down a toilet with water at room temperature, allowed to rest in the drain line for 15 or 60 minutes, and then measured for CDWT as described above.

Dispersibility

This test method evaluates the dispersibility of flushable consumer products, simulating travel through a wastewater conveyance system ("Slosh Box Test"). In this test method, a plastic tank is loaded with a product and 2 liters of tap water at room temperature. The container is then tipped back and forth at 26 oscillations per minute to simulate the movement of wastewater in the collection system. The time required for the wipe specimen to break up entirely into pieces that measure at most approximately 1 sq. in. (6.5 sq. cm) is recorded. The amount of time to reach this point is measured ("Slosh-Box Break-Up Time"). The construction and motion of the apparatus is conducted as set forth in the "Guidelines for Assessing the Flushability of Disposable Nonwoven Products, Third Edition, FG502—Slosh Box Disintegration Test," available from the "Association of the Nonwovens Fabrics Industry," 1100 Crescent Green, Suite 115, Cary, N.C., 27518, www.inda.org.

EXAMPLES

Examples 1-4 in the Table are dispersible wet wipes incorporating principles of the present invention. Each Example and the Control code employ a wipe substrate having two sub-layers of cellulosic fiber.

The first layer of each Example was an uncreped through-air dried ("UCTAD") tissue made of bleached Northern softwood kraft (NSWK) fibers and having a basis weight of 45 grams per square meter. To form the tissue, an aqueous solution of softwood fibers was pumped in a single layer through a headbox. The fiber was diluted to between 0.19 and 0.29 percent consistency in the headbox to ensure uniform formation. The resulting single-layered sheet structure was formed on a twin-wire, suction form roll. The speed of the forming fabric was 900 feet per minute (fpm). The newly-formed web was then dewatered to a consistency of about 20 to 27 percent using vacuum suction from below the forming fabric before being transferred to the transfer fabric, which was traveling at 738 fpm (18 percent rush transfer). A vacuum shoe pulling about 10 to 14 inches of mercury vacuum was used to transfer the web to the transfer fabric. A second vacuum shoe pulling about 4 to 10 inches of mercury vacuum was used to transfer the web to a through-air texturized drying fabric manufactured by Voith Fabrics Inc. The web was carried over a pair of honeycomb through-air dryers operating at temperatures of approximately 400 degrees Fahrenheit and dried to a final dryness of about 96 to 99 percent consistency. The dried cellulosic web was rolled onto a core to form a roll of tissue.

The second layer of each Example was an airlaid nonwoven web made of bleached southern softwood kraft (SSWK) fibers and having a basis weight of 30 grams per square meter. UCTAD tissue sheets were cut into handsheets approximately 10 inches by 13 inches in dimension. The airlaid nonwoven layer was formed directly onto the dried UCTAD tissue sheet in an airlaid hand-sheet former. The airlaid layer and the UCTAD tissue layer were pressed together using bench top hydraulic laboratory press (Carver, Inc., Wabash, Ind., USA), employing 3,000 pounds per square inch (psi) at 110 degrees Celsius for 5 seconds, and then embossed together using Beloit Wheeler heating compaction rolls, employing a 400 pounds per square inch (psi) nip pressure at 110 degrees Celsius.

All prototypes were made with a salt-sensitive binder composition having both a binder and a co-binder. The binder was cationic polyacrylate that is the polymerization product of 92 mol % methyl acrylate, 4 mol % hydroxypropyl acrylate and 4 mol % [2-(acrylolyoxy)ethyl]trimethyl ammonium chloride. The cobinder was VINNAPAS® EZ123, available from Wacker Chemi AG. The binder and the cobinder, both supplied in solution, were mixed together to yield a 70:30 binder:cobinder dry-weight ratio.

The two-layer composite of each prototype was sprayed with a single Unijet® spray nozzle, Nozzle type 800017, manufactured by Spraying Systems Co., Wheaton, Ill., operating at 80 psi. The salt-sensitive binder composition (in aqueous solution at 15 percent) was sprayed onto the airlaid layer of the two-layer composite of all codes (control and experimental codes) to yield a binder composition dry solids basis weight of 4 grams per square meter. The binder composition was sprayed onto the UCTAD layer of the two-layer composite to yield a binder composition dry solids basis weight of 4 grams per square meter (for the control), and either 2.0 or 2.95 grams per square meter (for the experimental codes). After being sprayed with the salt-sensitive binder solution, the two-layer composite tissue of each prototype was dried (cured) in a Mathis through-air dryer at a drying temperature of 180 degrees Celsius for 12 seconds (experimental codes) or 18 seconds (Control). The experimental codes were cured for less time than the Control code because they included less binder composition. The two-layer composite was then wound into a roll.

The composite was then unwound from the roll. The binder composition (in aqueous solution at 24 percent) was applied to the UCTAD layer of the two-layer composite of each experimental prototype in a pattern. The application was done via a rotor gravure applicator unit, using a 30 billion cubic microns per square inch anilox roll in contact with a transfer pattern roll and a backing roll. The anilox roll/transfer pattern roll nip was 0.375 inches (9.52 millimeters), and the transfer pattern roll/backing roll gap was also 0.375 inches (9.52 millimeters). The salt-sensitive binder composition was pattern-printed onto the UCTAD to yield a binder composition dry solids basis weight of 0.5 grams per square meter. The contact area (the percentage of the total surface area that is contacted, or printed, by the print transfer roll pattern) was 12.5 percent for both the "honeycomb" and "bowtie" patterns. After being pattern-printed with the salt-sensitive binder solution, the two-layer composite tissue of each prototype was dried (cured) in a Mathis through-air dryer at for approximately 5 seconds, and at a drying temperature of 180 degrees Celsius.

A wetting solution was added to the wipes at an add-on rate of 215 percent of the weight of the dry wipe, and the wetting solution comprised 2 weight-percent of sodium chloride. The web was converted into stacks of wipes, and stored in moisture-impervious plastic bags.

For each Example listed in the Table, five specimens, roughly 2.5 centimeters by 14 centimeters in dimension, were tested for CDWT, in units of grams per linear inch, and additional specimens were tested for CDWT after being soaked for fifteen (15) and sixty (60) minutes in tap water at room temperature, and results averaged. The cross-machine direction wet tensile strength was measured because in certain dispensing formats, the extraction force placed upon the wipe during dispensing is in the cross-machine direction. The 15 minute soak was intended to simulate the minimum time that a wipe typically resides in a home drain line after being flushed (although typically wipes reside in the home drain line longer than 15 minutes, such as closer to 60 minutes).

The time required for each wipe to break apart into pieces none of which were larger than approximately one square inch (6.5 square centimeters) was measured via the Slosh-Box test described above.

The key design details and the dispersibility data for the Control and the experimental examples is presented in the TABLE below.

TABLE

| Example | Control | 1 | 2 | 3 | 4 |
|---|---|---|---|---|---|
| Sprayed Binder add-on level, airlaid sub- layer (gsm) | 4.0 | 4.0 | 4.0 | 4.0 | 4.0 |
| Sprayed Binder add-on level UCTAD sub-layer (gsm) | 4.0 | 2.0 | 2.0 | 2.95 | 2.95 |
| Printed Binder add-on level, UCTAD sub- layer (gsm) | 0 | 0.5 | 0.5 | 0.5 | 0.5 |
| Printed Binder Pattern | n/a | Honey-comb | Bow-tie | Honey-comb | Bow-tie |
| CDWT Strength (gli) | 281 | 208 | 203 | 211 | 262 |
| CDWT Strength 15 min after flushing | 191 | 96 | 93 | 87 | 82 |
| Strength Loss 15 mins after flushing (%) | 32% | 54% | 54% | 59% | 69% |
| CDWT Strength 60 min after flushing | 94 | 64 | 61 | 50 | 64 |
| Strength Loss 60 mins after flushing (%) | 67% | 69% | 70% | 76% | 76% |
| Slosh Box Break-Up Time (min) | 180 | 74 | 78 | 80 | 127 |

As shown by the data, the experimental codes embodying principles of the invention exhibited satisfactory pre-use wet strength (that is, CDWT above 200 grams per linear inch), exhibited faster strength loss after flushing (particularly when tested at 15 minutes after flushing), and exhibited faster Slosh-Box break up times.

Other modifications and variations to the appended claims may be practiced by those of ordinary skill in the art, without departing from the spirit and scope as set forth in the appended claims. It is understood that features of the various examples may be interchanged in whole or part. The preceding description, given by way of example in order to enable one of ordinary skill in the art to practice the claimed invention, is not to be construed as limiting the scope of the invention, which is defined by the claims and all equivalents thereto.

What is claimed is:

1. A dispersible wet wipe comprising:

a layer of cellulosic fibers comprising a first sub-layer of wetlaid tissue and a second sub-layer of airlaid tissue, the layer having a first surface and a second surface;

a first binder applied in a coating on the first surface, wherein the coating comprises randomly distributed deposits of the first binder; and a second binder applied in an intermittent pattern on the first surface to define first regions on the first surface that include first binder but no second binder and to define second regions on the first surface that include both first binder and second binder.

2. The dispersible wet wipe of claim 1, wherein the coating is a spray coating.

3. The dispersible wet wipe of claim 1, wherein the intermittent pattern is a roll-printed pattern.

4. The dispersible wet wipe of claim 1, wherein the intermittent pattern is a lattice pattern.

5. The dispersible wet wipe of claim 1, wherein the intermittent pattern comprises continuous lines of second binder that extend in a primarily cross-machine direction, and wherein the intermittent pattern does not comprise continuous lines of second binder that extend in a primarily machine direction.

6. The dispersible wet wipe of claim 1, wherein both the first binder and the second binder comprise a water-dilution triggerable polymer.

7. The dispersible wet wipe of claim 6 further comprising a wetting solution, the wetting solution comprising an insolubilizing agent that renders stable the first and second binders prior to the wipe being flushed in a toilet.

8. The dispersible wet wipe of claim 1, the first binder further applied in a coating on the second surface, wherein the coating comprises randomly distributed deposits of the first binder; and the second binder further applied in an intermittent pattern on the second surface to define first regions on the second surface that include first binder but no second binder and to define second regions on the second surface that include both first binder and second binder.

9. A dispersible wet wipe comprising:

a layer of cellulosic fibers comprising a first sub-layer of wetlaid tissue and a second sub-layer of airlaid tissue, the layer having a first surface and a second surface;

a first binder applied to the first surface in a continuous and pattern-less coating; and a second binder applied to the first surface in a discontinuous pattern to define first regions on the first surface that include first binder but no second binder and to define second regions on the first surface that include both first binder and second binder.

10. The dispersible wet wipe of claim 9, wherein the coating is a spray coating.

11. The dispersible wet wipe of claim 9, wherein the discontinuous pattern is a lattice pattern.

12. The dispersible wet wipe of claim 9, wherein the discontinuous pattern comprises continuous lines of second binder that extend in a primarily cross-machine direction, and wherein the discontinuous pattern does not comprise continuous lines of second binder that extend in a primarily machine direction.

13. The dispersible wet wipe of claim 9, wherein the first binder and second binder have the same chemical composition.

14. The dispersible wet wipe of claim 9, the first binder further applied to the second surface in a continuous and pattern-less coating; and the second binder further applied to the second surface in a discontinuous pattern to define first regions on the second surface that include first binder but no second binder and to define second regions on the second surface that include both first binder and second binder.

15. A dispersible wet wipe comprising:

a layer of cellulosic fibers comprising a first sub-layer of wetlaid tissue and a second sub-layer of airlaid tissue, the layer having a first surface having a first surface area and a second surface having a second surface area;

a first binder applied to the first surface to define a first binder surface area, a second binder applied to the first surface to define a second binder surface area, wherein the second binder surface area is at most 50 percent of the first binder surface area.

16. The dispersible wet wipe of claim 15, wherein the second binder surface area is at most 10 percent of the first binder surface area.

17. The dispersible wet wipe of claim 15, wherein the first binder surface area is 100 percent of the first surface area.

18. The dispersible wet wipe of claim 15, wherein the second binder is applied in a lattice pattern.

19. The dispersible wet wipe of claim 15, wherein the first binder and second binder have the same chemical composition.

20. The dispersible wet wipe of claim 15, wherein the first binder is further applied to the second surface to define a second surface first binder surface area; and the second binder is further applied to the second surface to define a second surface second binder surface area, wherein the second surface second binder surface area is at most 10 percent of the second surface first binder surface area.

* * * * *